US006684839B2

(12) United States Patent
Yang

(10) Patent No.: US 6,684,839 B2
(45) Date of Patent: Feb. 3, 2004

(54) IGNITION OR FUEL INJECTION CONTROL SYSTEM WITH AUXILIARY SOURCE

(76) Inventor: Tai-Her Yang, No. 59, Chung Hsing 8 St., Si-Hu Town, Dzan-Hwa (TW)

( * ) Notice: Subject to any disclaimer, the term of this patent is extended or adjusted under 35 U.S.C. 154(b) by 192 days.

(21) Appl. No.: 10/044,972

(22) Filed: Jan. 15, 2002

(65) Prior Publication Data

US 2003/0131816 A1 Jul. 17, 2003

(51) Int. Cl.[7] ..... F02N 17/00

(52) U.S. Cl. ..... 123/179.1; 123/179.5

(58) Field of Search ..... 123/179.1, 179.5, 123/179.24; 290/50; 320/104

(56) References Cited

U.S. PATENT DOCUMENTS 4,847,545 A * 7/1989 Reid ..... 320/104
5,637,978 A * 6/1997 Kellett et al. ..... 320/104
6,593,722 B2 * 7/2003 Purdy ..... 320/104

* cited by examiner

*Primary Examiner*—Bibhu Mohanty
(74) *Attorney, Agent, or Firm*—Bacon & Thomas, PLLC

(57) ABSTRACT

An ignition system or a fuel injection system provided with a dedicated auxiliary source for the ignition device or the fuel injection control system and a separation diode to separate the auxiliary source from the battery source for the start-up motor thus to ensure good ignition performance by avoiding voltage drop at an ignition device or the fuel injection control system due to larger current is drawn by a start-up motor while starting an engine.

7 Claims, 2 Drawing Sheets

IGNITION OR FUEL INJECTION CONTROL SYSTEM WITH AUXILIARY SOURCE

BACKGROUND OF THE INVENTION (a) Field of the Invention

The present invention is related to an ignition or fuel injection control system to ensure good ignition performance by avoiding voltage drop at an ignition device or a fuel injection control device due to larger current is drawn by a start-up motor while starting an engine; and more particularly, to one that is comprised of an auxiliary source dedicated for the ignition device or the fuel injection control system and a separation diode to separate the auxiliary source from the battery source for the start-up motor.

(b) Description of the Prior Art

In the prior art, the engine ignition system or the fuel injection control system and start-up motor share a common battery source. However, a significant drop (usually for 25~40%) of the battery source due to larger current is required by the start-up motor. As a result, poor ignition efficiency or slower switching rate of the fuel injection control system makes starting up the engine particularly difficult.

SUMMARY OF THE INVENTION

The primary purpose is to provide an ignition or fuel injection control system with an auxiliary source that is separated from the primary system. To achieve the purpose, an auxiliary source dedicated for the ignition device or the fuel injection control system and a separation diode to separate the auxiliary source from the battery source for the start-up motor are provided to ensure good ignition efficiency by avoiding a sudden drop at an ignition device or a fuel injection control device due to larger current is drawn to the start-up motor while starting an engine.

DETAILED DESCRIPTION OF THE PREFERRED EMBODIMENTS

An ignition or fuel injection control system to ensure good ignition efficiency is provided with a dedicated auxiliary source separated from a primary system with a separation diode to a void sudden drop at the ignition or the fuel injection control system due to significant battery drop, taking place as a start-up motor draws larger currents while starting the engine.

Figure 1:
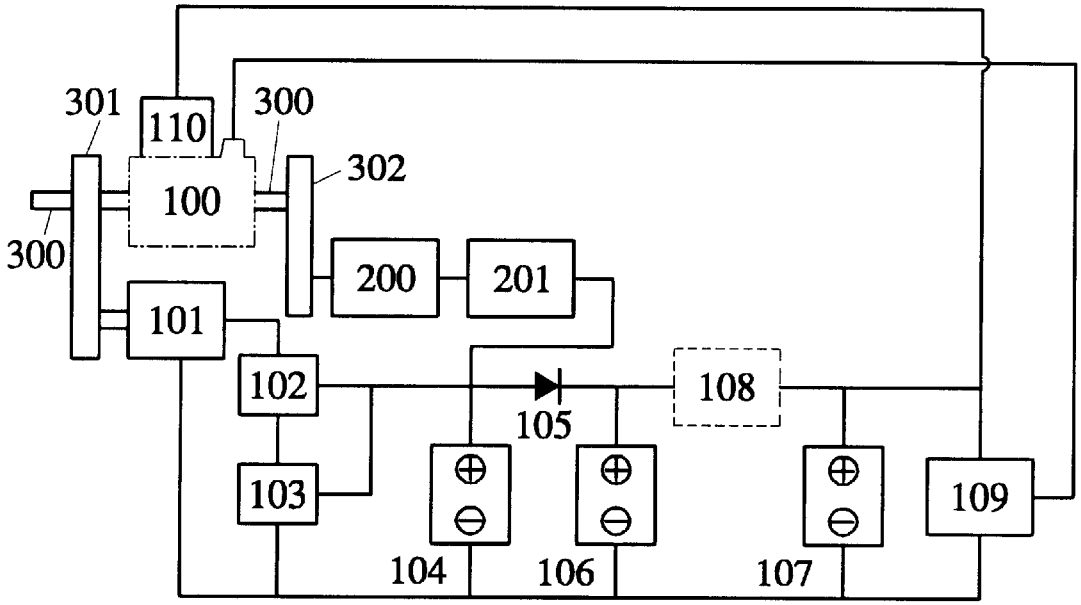
FIG. 1 is a circuit block chart of a preferred embodiment of the present invention.

FIG. 1 shows a circuit block chart of an ignition system or fuel injection control system provided with the dedicated auxiliary source separated from the primary system of the present invention. Wherein, the dedicated auxiliary source for the ignition or the fuel injection control system and the separation diode to separate the auxiliary source from the battery source for the start-up motor include:

- an engine 100: comprised of an internal-combustion engine using diesel, gasoline engine, natural gas, or methanol as fuel and provided with a start-up motor 101;
- a start-up motor 101: comprised of a brush or brushless DC or AC motor, or a power generator with functions of a motor, manipulated by a motor start relay 102 to manipulate the battery source driven start-up motor 101 and further to draw the engine 100 through a transmission 302;
- a start-up switch 103: comprised of a mechano-electronic device or a solid-state electronic switching device to manipulate an ignition device and the motor start relay 102 or other car-laden electric devices,
- a primary battery 104: comprised of a rechargeable secondary battery or a super capacitor;
- a separation diode 105: comprised of a diode, provided between the primary battery 104 and a first rechargeable auxiliary storage 106 to execute one-way conduction of currents from the primary battery 104 to charge the first rechargeable auxiliary storage 106;
- a first rechargeable auxiliary storage 106: comprised of a rechargeable battery or a super capacitor, to store power for the primary battery 104, or car-laden power generator or other charging devices; being prevented from inverse discharging to the primary battery 104 by means of the separation diode 105; alternatively, a limiting impedance 108 comprised of a limiting induction or resistance connected in series is provided between the first rechargeable auxiliary storage 106 and a second rechargeable auxiliary storage 107 to limit the power discharged from the first rechargeable auxiliary storage 106 at the instant of ignition so to allow the full discharge to the ignition device by the second rechargeable auxiliary storage 107 before accepting the charging power from the first rechargeable auxiliary storage 106 through the limiting impedance 108 comprised of the limiting induction or resistance;
- a second rechargeable auxiliary storage 107: comprised of a rechargeable secondary battery or a super capacitor to supply instant power to the engine ignition device 109 upon igniting the engine;
- a power generation unit 200: comprised of a AC or DC power generator, drawn by the engine and a rear transmission 302 to produce DC output relatively rectified AC, or to forthwith produce DC output;
- a regulation device 201: to regulate power outputted from the power generator into power supply that can be consumed by the primary battery 104, the first rechargeable auxiliary storage 106, the second rechargeable auxiliary storage 107 and other loads; and
- an engine shaft 300: to output engine rpm to drive a load, to couple a front transmission 301 to the start-up motor 101, and to couple to the power generation unit 200 through a rear transmission 302;
- an engine ignition device 109: comprised of a mechano-electronic or a solid-state electronic circuit device, or combined thereof, to ignite the internal-combustion engine to keep engine running;
- a fuel injection control system 110: comprised of a fuel injection mechanism to execute throttle switching by controlling fuel ejection gap, and a circuit control device to control the fuel injection mechanism by referring to throttle openness, oil temperature, air inlet temperature, IP-ARB signals; the engine ignition device or the fuel injection control system 110 may be either or both provided as applicable.

In field application of the ignition or fuel injection control system provided with auxiliary source separated from the primary system of the present invention, the first rechargeable storage 106 with higher energy density and the secondary rechargeable storage 107 with higher power density may be selected to match ignition efficiency and cost efficiency.

Figure 2:
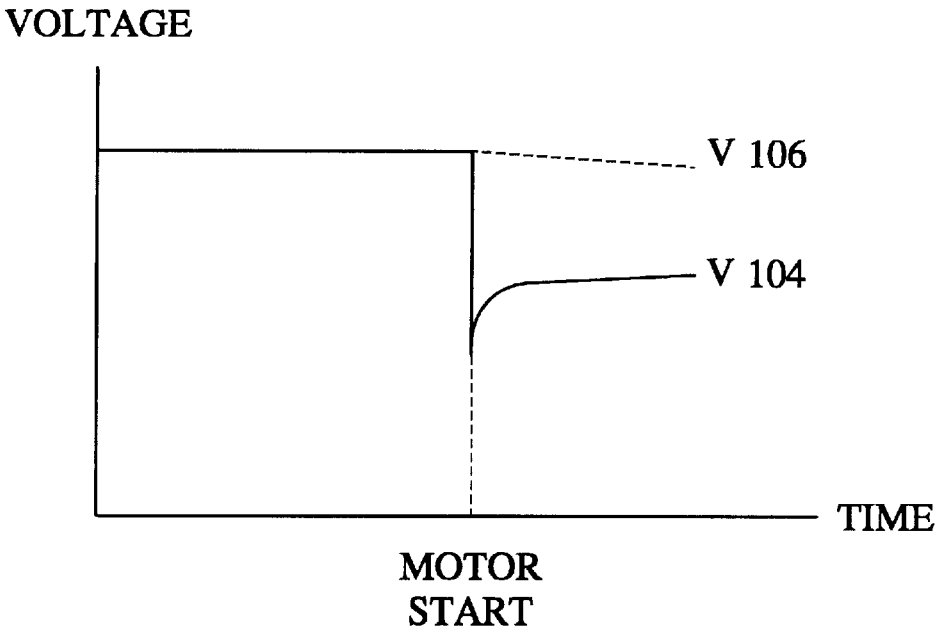
FIG. 2 is a schematic view showing the change of battery voltage vs. motor start of the preferred embodiment illustrated in FIG. 1.

FIG. 2 shows the battery voltage vs. motor start of the preferred embodiment of the present invention illustrated in FIG. 1. Wherein, a voltage V106 is the terminal voltage of the first rechargeable auxiliary storage 106; and V104, that of the primary battery 104.

Figure 3:
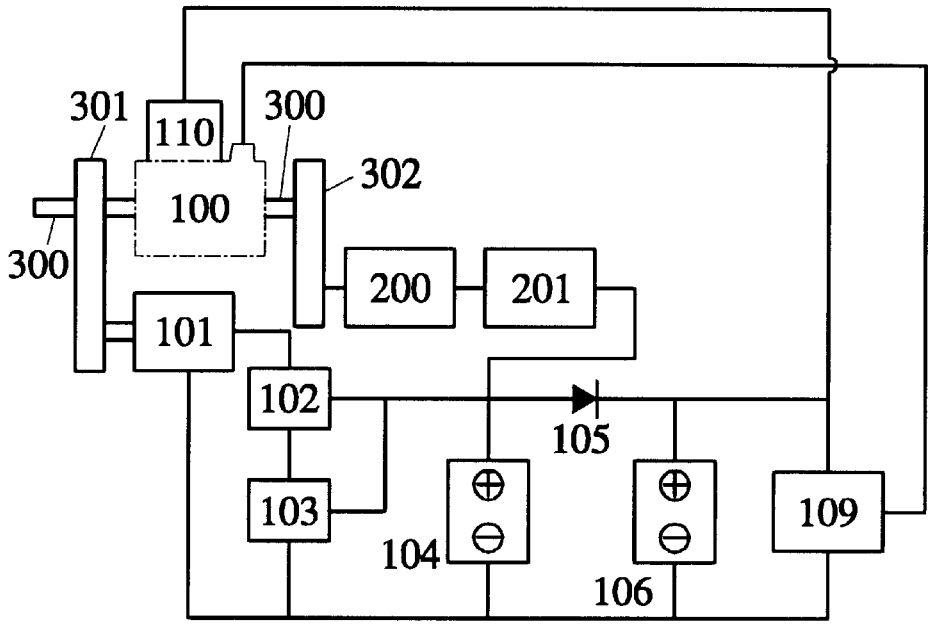
FIG. 3 is a circuit block chart of the preferred embodiment illustrated in FIG. 1 with the absence of a secondary rechargeable auxiliary storage and limiting impedance.

Furthermore, the ignition or fuel injection control system provided with auxiliary source separated from the primary system of the present invention is provided with the absence of the second rechargeable auxiliary storage and the limiting impedance. FIG. 3 shows the circuit block with such absence. Within, by omitting the second rechargeable auxiliary storage 107 and the limiting impedance 108, instead, a separation diode 105 is connected in series in positive direction between the primary battery 104 and the first rechargeable auxiliary storage 106 to execute one-way conduction to limit charging power to the first rechargeable auxiliary storage 106 by the primary battery 104, thus for the first rechargeable auxiliary storage 106 to supply power required by the engine ignition device 109 or by the fuel injection control system 110.

Figure 4:
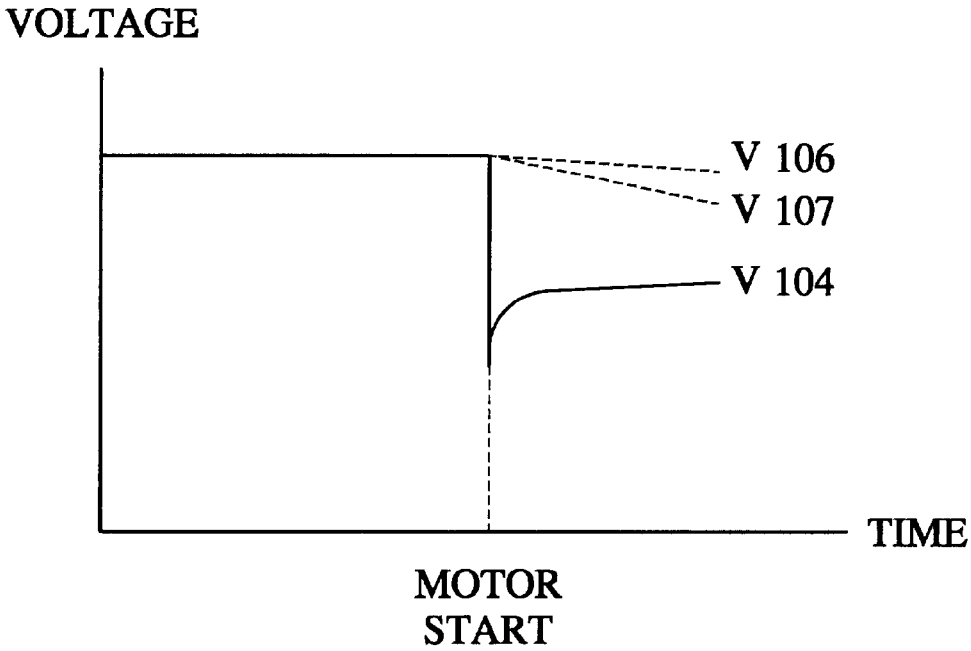
FIG. 4 is a schematic view showing battery voltage vs. motor start of the preferred embodiment illustrated in FIG. 3.
Figure 1:
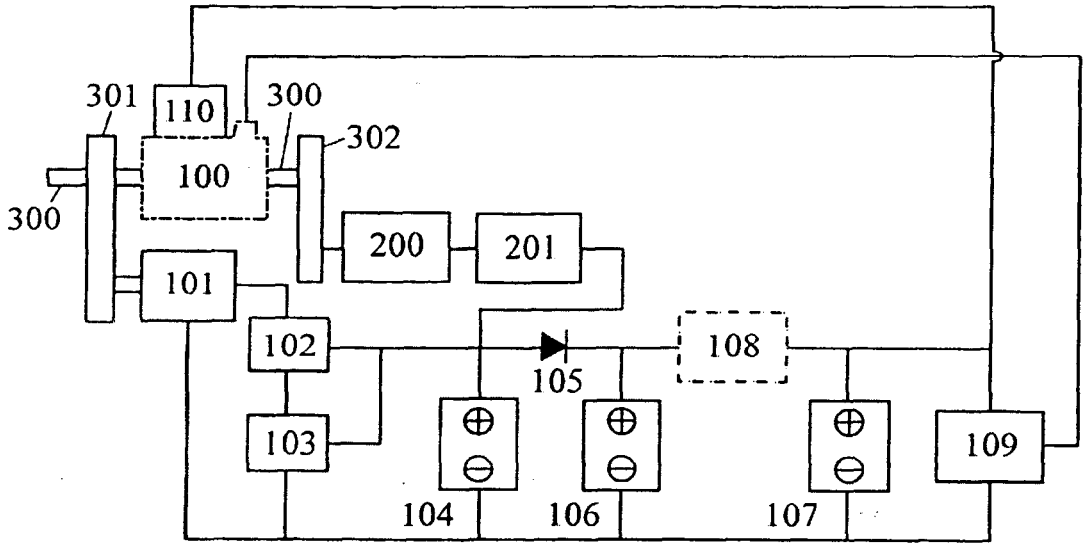
Figure 2:
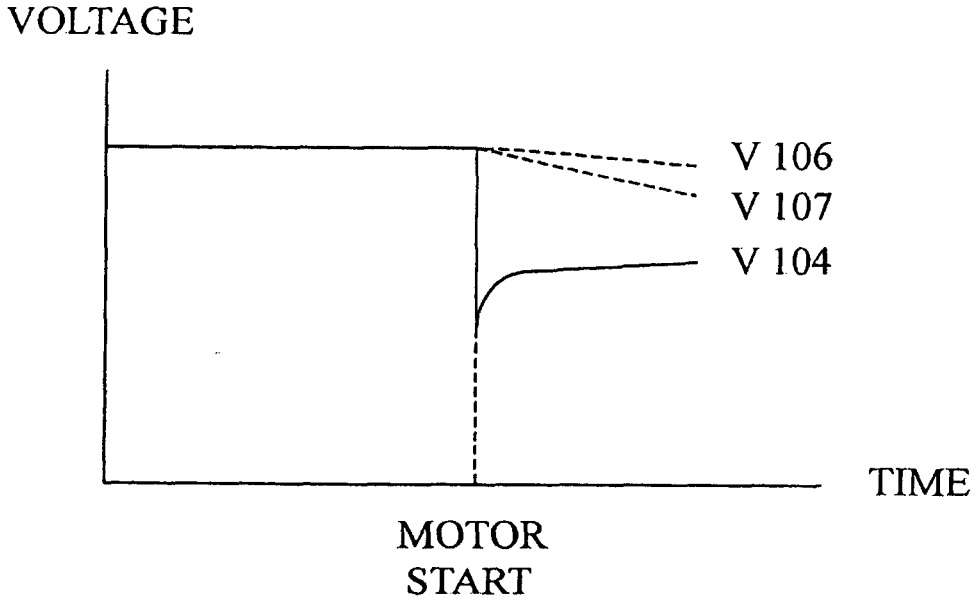
Figure 3:
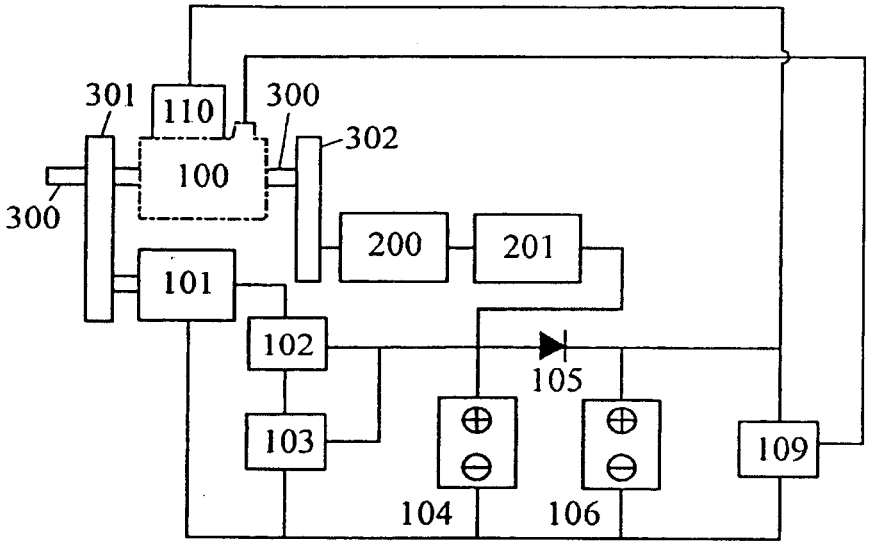
Figure 4:
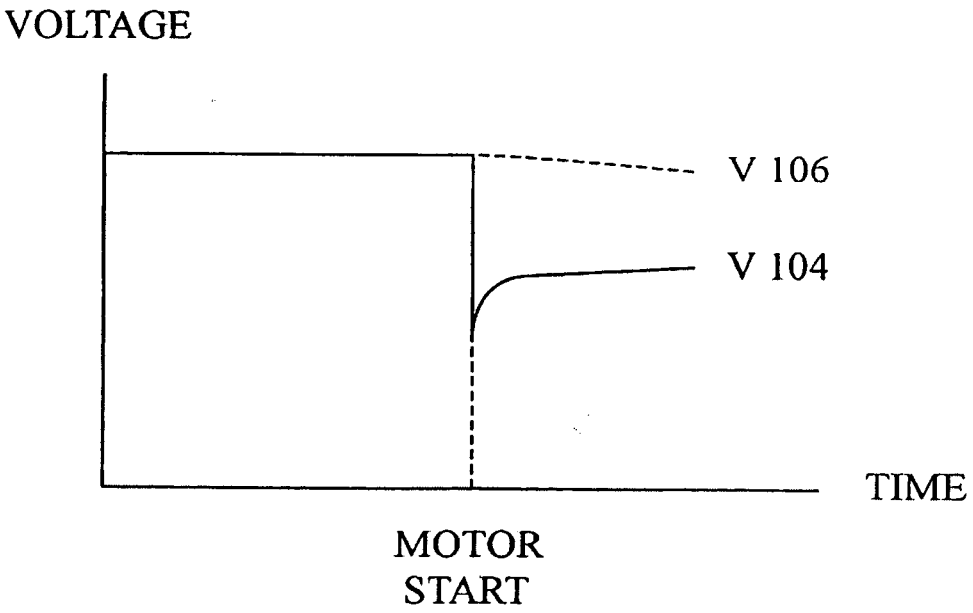

FIG. 4 shows the battery voltage vs. motor start for the preferred embodiment illustrated in FIG. 3. Wherein, a voltage V106 is the terminal voltage of the first rechargeable auxiliary storage 106; V107, the second rechargeable auxiliary storage 107; and V104, the primary battery 104.

The engine ignition device 109 or the fuel injection control system 110, the first rechargeable auxiliary storage 106, the limiting impedance 108 and the second rechargeable auxiliary storage 107 disclosed above in FIG. 1 may be separately structured or sharing a common structure; while the engine ignition device 109 illustrated in FIG. 3 or the fuel injection control system 110 and either or both of the first rechargeable auxiliary storage 106 and the secondary rechargeable auxiliary storage 107 may be separately structured or sharing a common structure.

In the ignition or the fuel injection control system provided with a dedicated auxiliary source, he engine ignition device 109 and either or both of the first rechargeable auxiliary storage 106 and the secondary rechargeable auxiliary storage 107 may be independently structured. The fuel injection control system 110 and either or both of the first rechargeable auxiliary storage 106 and the secondary rechargeable auxiliary storage 107 may be independently structured.

As disclosed, the ignition system or the fuel injection control system provided with a dedicated auxiliary source separated from the primary system for being capable of maintaining good ignition efficiency or fuel injection performance by supplying power only to the engine ignition device or the fuel injection control system from the rechargeable auxiliary storage by means of a separation diode when a significant drop in the primary battery takes place due to larger currents from the primary battery are drawn at the instant of starting the engine is innovative with precise functions. Therefore, this application is duly filed accordingly.

What is claimed is:

1. An ignition system or a fuel injection control system to ensure good ignition efficiency is provided with a dedicated auxiliary source separated from a primary system with a separation diode to avoid sudden drop at the ignition or the fuel injection control system due to significant battery drop, taking place as a start-up motor draws larger currents while starting the engine, essentially comprised of:

an engine 100: comprised of an internal-combustion engine using diesel, gasoline engine, natural gas, or methanol as fuel and provided with a start-up motor 101;

the start-up motor 101: comprised of a brush or brushless DC or AC motor, or a power generator with functions of a motor, manipulated by a motor start relay 102 to manipulate the battery source driven start-up motor 101 and further to draw the engine 100 through a transmission 302;

a start-up switch 103: comprised of a mechano-electronic device or a solid-state electronic switching device to manipulate an ignition device and the motor start relay 102 or other car-laden electric devices;

a primary battery 104: comprised of a rechargeable secondary battery or a super capacitor;

a separation diode 105: comprised of a diode, provided between the primary battery 104 and a first rechargeable auxiliary storage 106 to execute one-way conduction of currents from the primary battery 104 to charge the first rechargeable auxiliary storage 106;

the first rechargeable auxiliary storage 106: comprised of a rechargeable battery or a super capacitor, to store power for the primary battery 104, or car-laden power generator or other charging devices; being prevented from inverse discharging to the primary battery 104 by means of the separation diode 105; alternatively, a limiting impedance 108 comprised of a limiting induction or resistance connected in series is provided between the first rechargeable auxiliary storage 106 and a second rechargeable auxiliary storage 107 to limit the power discharged from the first rechargeable auxiliary storage 106 at the instant of ignition so to allow the full discharge to the ignition device by the second rechargeable auxiliary storage 107 before accepting the charging power from the first rechargeable auxiliary storage 106 through the limiting impedance 108 comprised of the limiting induction or resistance;

the second rechargeable auxiliary storage 107: comprised of a rechargeable secondary battery or a super capacitor to supply instant power to the engine ignition device 109 upon igniting the engine;

a power generation unit 200: comprised of a AC or DC power generator, drawn by the engine and a rear transmission 302 to produce DC output relatively rectified AC, or to forthwith produce DC output;

a regulation device 201: to regulate power outputted from the power generator into power supply that can be consumed by the primary battery 104, the first rechargeable auxiliary storage 106, the second rechargeable auxiliary storage 107 and other loads; and an engine shaft 300: to output engine rpm to drive a load, to couple a front transmission 301 to the start-up motor 101, and to couple to the power generation unit 200 through a rear transmission 302;

a engine ignition device 109: comprised of a mechano-electronic or a solid-state electronic circuit device, or combined thereof, to ignite the internal-combustion engine to keep engine running;

a fuel injection control system 110: comprised of a fuel injection mechanism to execute throttle switching by controlling fuel ejection gap, and a circuit control device to control the fuel injection mechanism by referring to throttle openness, oil temperature, air inlet temperature, IP-ARB signals; either or both of the engine ignition device or the fuel injection control system 110 is or are provided as applicable.

2. An ignition system or a fuel injection control system as claimed in claim 1, wherein, the first rechargeable storage 106 with higher energy density and the secondary rechargeable storage 107 with higher power density are selected to match ignition efficiency and cost efficiency.

3. An ignition system or a fuel injection control system as claimed in claim 1, wherein, both of the second rechargeable auxiliary storage 107 and the limiting impedance 108 are omitted, instead, a separation diode 105 is connected in series in positive direction between the primary battery 104 and the first rechargeable auxiliary storage 106 to execute one-way conduction to limit charging power to the first rechargeable auxiliary storage 106 by the primary battery 104, thus for the first rechargeable auxiliary storage 106 to supply power required by the engine ignition device 109 or by the fuel injection control system 110.

4. An ignition system or a fuel injection control system as claimed in claim 1, wherein, the engine ignition device 109 or the fuel injection control system 110, the first rechargeable auxiliary storage 106, the limiting impedance 108 and the second rechargeable auxiliary storage 107 are separately structured or sharing a common structure.

5. An ignition system or a fuel injection control system as claimed in claim 1, wherein, the engine ignition device 109 or the fuel injection control system 110, the first rechargeable auxiliary storage 106, and either or both of the first rechargeable auxiliary storage 106 and the secondary rechargeable auxiliary storage 107 are separately structured or sharing a common structure.

6. An ignition system or a fuel injection control system as claimed in claim 1, wherein, the engine ignition device 109 and either or both of the first rechargeable auxiliary storage 106 and the secondary rechargeable auxiliary storage 107 are independently structured.

7. An ignition system or a fuel injection control system as claimed in claim 1, wherein, the fuel injection control system 110 and either or both of the first rechargeable auxiliary storage 106 and the secondary rechargeable auxiliary storage 107 are independently structured.

* * * * *

UNITED STATES PATENT AND TRADEMARK OFFICE

CERTIFICATE OF CORRECTION

PATENT NO. : 6,684,839 B2
APPLICATION NO. : 10/044972
DATED : February 3, 2004
INVENTOR(S) : Tai-Her Yang It is certified that error appears in the above-identified patent and that said Letters Patent is hereby corrected as shown below:

In col. 3, line 15, insert after "storage 106": --a voltage V107 is the terminal voltage of the second rechargeable auxiliary storage 107,--.

In col. 3, lines 35-36, delete: "V107, the second rechargeable auxiliary storage 107;".

Please replace the original drawings with the attached replacement drawings, in which "Fig. 2" has been re-numbered as --Fig. 4--, and "Fig. 4" has been re-numbered as --Fig. 2.--

Signed and Sealed this

Tenth Day of October, 2006

JON W. DUDAS
*Director of the United States Patent and Trademark Office*